United States Patent [19]

Cushing

[11] 4,381,432

[45] Apr. 26, 1983

[54] ELECTROMECHANICAL TIMER WITH IMPROVED SHORT INTERVAL ACCURACY

[75] Inventor: Donald S. Cushing, Louisville, Ky.

[73] Assignee: General Electric Company, Louisville, Ky.

[21] Appl. No.: 268,939

[22] Filed: Jun. 1, 1981

[51] Int. Cl.[3] ..... H01H 43/10

[52] U.S. Cl. ..... 200/38 B; 200/27 B; 200/283

[58] Field of Search ..... 200/27 R, 27 B, 27 BA, 200/30 R, 30 A, 31 R, 31 AA, 38 R, 38 FA, 38 B, 38 BA, 38 C, 38 CA, 153 LB, 283, 284; 74/568 T, 569

[56] References Cited

U.S. PATENT DOCUMENTS

| | | | |
|---|---|---|---|
| 2,366,454 | 1/1945 | Pattee | 200/33 |
| 2,583,245 | 1/1952 | Van Valkenburgh et al. | 161/1 |
| 2,636,949 | 4/1953 | Hunter | 200/27 |
| 2,778,418 | 1/1957 | Laviana | 161/1 |
| 2,864,443 | 12/1958 | Niemand | 161/15 |
| 2,905,777 | 9/1959 | Gayring | 200/38 |
| 2,939,337 | 6/1960 | Sweger | 200/153 LB X |
| 2,953,667 | 9/1960 | Kavanaugh | 200/153 |
| 3,342,695 | 9/1967 | Felsenfeld | 195/102 |
| 3,472,976 | 10/1969 | Hunt | 200/38 |
| 3,725,617 | 4/1973 | Boyles et al. | 200/38 |
| 3,752,944 | 8/1973 | Cartier et al. | 200/283 X |
| 3,814,874 | 6/1974 | Brown . | |
| 3,818,157 | 6/1974 | Voland et al. | 200/38 |
| 3,846,597 | 11/1974 | Ziegler, Jr. | 200/38 |
| 3,930,131 | 12/1975 | Nishina | 200/35 |
| 3,941,000 | 3/1976 | Allison, Jr. | 74/3.5 |
| 3,987,688 | 10/1976 | Tarbet | 74/568 |
| 4,020,625 | 5/1977 | Mahon et al. | 58/21.13 |

*Primary Examiner*—J. R. Scott

*Attorney, Agent, or Firm*—H. Neil Houser; Radford M. Reams

[57] ABSTRACT

An improved electromechanical timer for accurately controlling relatively short time intervals, such as fill time intervals for washing appliances. A cam-actuated switch includes a first cam-following member rigidly supported from a first contact arm and a second cam-following member movably, preferably pivotally, supported from the first cam-following member. The switch actuating control cam is of the circumferential edge track type rotatably driven by a timer motor. The first cam-following member is biased into cam-following engagement with the cam track by the resiliency of the contact arm. The second cam-following member extends between the cam track and a second contact arm and is biased into cam-following engagement with the track by the second contact arm. The cam track includes a plurality of arcuate segments of different fixed radii. The first and second contact arms are held out of electrical contact with each other by the cam-following members when the cam-following members concurrently engage segments of equal radii and are permitted to move into electrical contact with each other when the second cam-following member engages an arcuate segment of lesser radius than that concurrently engaged by the first cam-following member. The time period during which the cam-actuated switch remains closed is a function of the distance between trailing edges of the cam-following members.

6 Claims, 15 Drawing Figures

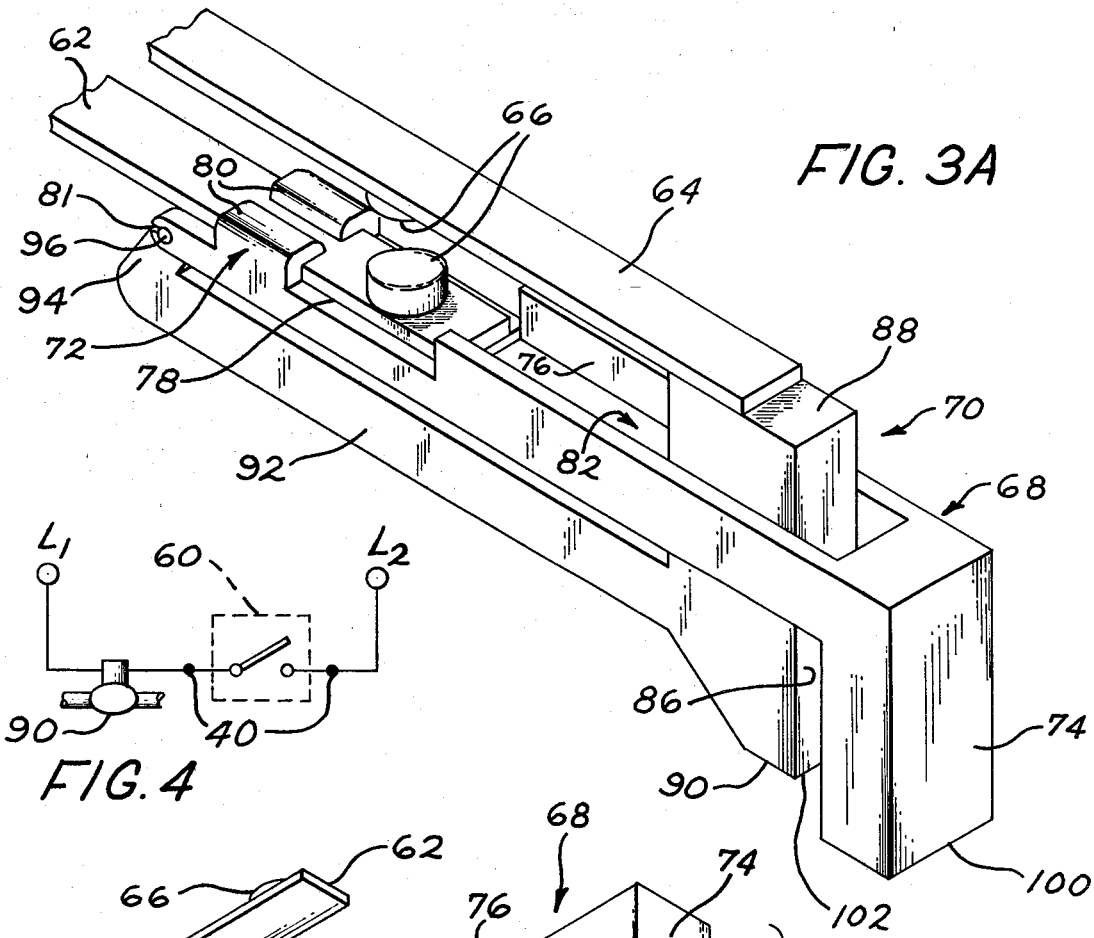
FIG. 3A
FIG. 4
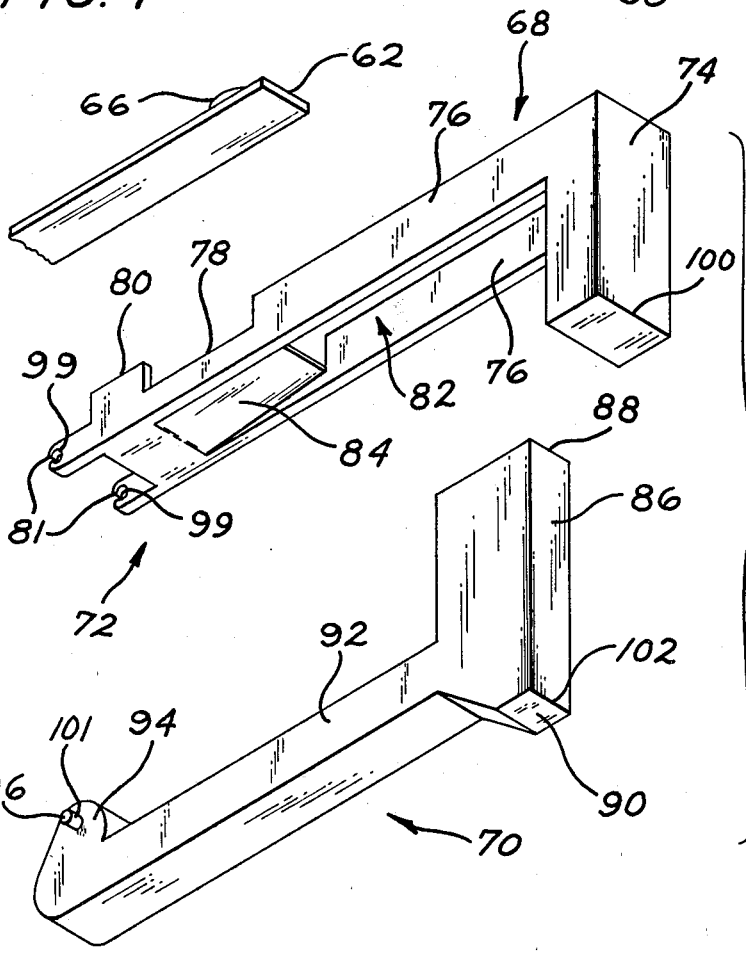
FIG. 3B

ELECTROMECHANICAL TIMER WITH IMPROVED SHORT INTERVAL ACCURACY

BACKGROUND OF THE INVENTION

Modern automatic washing appliances such as dishwashers and clothes washing machines commonly employ electromechanical timers for controlling various cyclical appliance operations. Typically, timing accuracy is subject to relatively high tolerance variations. For appliances employing time-controlled fill cycles, high tolerance variations can result in excess water usage beyond that required for satisfactory washing performance. For example, on a 78 minutes per revolution timer cam such as typically employed in a dishwasher, the fill time interval may have up to a plus or minus 8 seconds fill time variation because of the many interacting tolerances in the timer. Nominal dishwasher appliance fill flow rates are on the order of 1.75 gallons/minute. At such rates, a time variation of plus or minus 8 seconds results in a variation of plus or minus roughly 2 pints of water during each fill cycle. For dishwasher having 6 fill cycles for each load of dishes, the variation in total water usage per load is on the order of plus or minus roughly 1.5 gallons.

One technique known in the art for improving the accuracy of such timers is to employ a drop-to-start, drop-to-stop arrangement. In such an arrangement each resilient contact arm carries a cam follower biased against the control cam track. The control switch is made when the first cam follower drops and opened when the second cam follower drops. Such an approach eliminates the rise portion of the track profile and the gap between contact arms and the relative positioning of cam and switch block as sources of tolerance variations. However, even with this double drop approach, positioning of each cam follower on its corresponding contact arm and the relative positioning of the contact arms themselves remain as significant sources of tolerance variations.

In order to reduce water usage in washing appliances such as dishwashers, an electrical mechanical timer of relatively simple construction which provides improved accuracy capability, particularly for short intervals, is needed.

It is therefore an object of the present invention to provide an improved electromechanical timer for washing appliances which increases the timing accuracy for short time intervals.

It is a further object of the present invention to provide an improved electromechanical timer for appliances which improves the timer accuracy for relatively short time intervals by housing a minimum number of interacting tolerances associated with the timer structure.

SUMMARY OF THE INVENTION

The invention provides an electro-mechanical timer with improved means for controlling relatively short intervals, such as fill time intervals for washing appliances, with greater accuracy than conventional electromechanical timers. In accordance with one aspect of the invention, the timer includes at least one cam-actuated switch, comprising first and second resilient contact arms movable into and out of electrical contact with each other for opening and closing the switch. A first cam-following member rigidly extends from the first contact arm and is biased into cam-following engagement with the timer control cam track by the resiliency of the first contact arm. A second cam-following member is movably mounted to the first cam-following member and extends between the second contact arm and the control cam track. This second cam-following member is biased into cam-following engagement with the cam track by the resiliency of the second contact arm. The first and second cam-following members control the movement of first and second contact arms, respectively, into and out of electrical contact with each other in accordance with the control cam track profile. The control cam track comprises a plurality of arcuate segments of different fixed radii defining a stepped cam track profile. In one preferred form of the invention, the first and second contact arms are moved out of electrical contact with each other when the first and second cam-following members concurrently engage arcuate segments of substantially equal radii and are moved into electrical contact with each other when the second cam-following member engages an arcuate segment of lesser radius than the arcuate segment concurrently engaged by the first cam-following member. In this manner the time period during which the cam-actuated switch remains closed is a function of the distance between the first and second cam-following members.

In accordance with another form of the present invention, an accurately controlled time interval of extended duration is achieved with the same cam follower arrangement using a cam track profile comprising first, second and third arcuate segments having first, second and third fixed radii, respectively, sequentially arranged in an order of decreasing radius in the direction opposite the direction of rotation of the control cam. The arcuate length of the second segment is less than the arcuate distance between the first and second cam-following members so that the second cam-following member moves from the second segment to the third segment before the first cam-following member moves from the first segment to the second segment. In this manner the time period during which the cam-actuated fill control switch remains closed is extended as a function of the arcuate length of the second segment. The total time period during which the fill control switch remains closed is then a function of the sum of the arcuate length of the second cam track segment and the distance between the first and second cam-following members.

BRIEF DESCRIPTION OF THE DRAWINGS

FIG. 3A is an enlarged perspective view of a contact arm and associated cam-following members of the electro-mechanical timer of FIG. 1.

FIG. 3B is an exploded perspective view of the contact arm and cam-following members of FIG. 3A.

FIG. 4 is a schematic circuit diagram showing a fill valve solenoid in series with a cam-actuating switch of the timer of FIG. 1.

DETAILED DESCRIPTION

Figure 1:
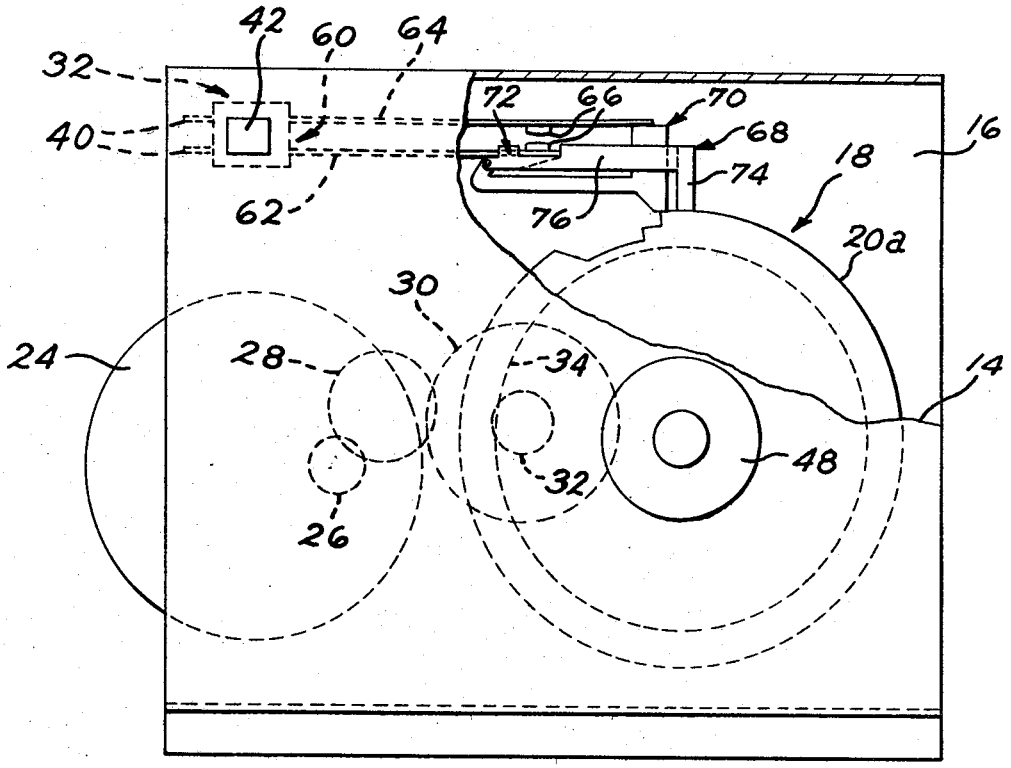
FIG. 1 is a front elevational view of an electromechanical timer embodying the present invention with portions cut away to show the internal structure of the timer.
Figure 2:
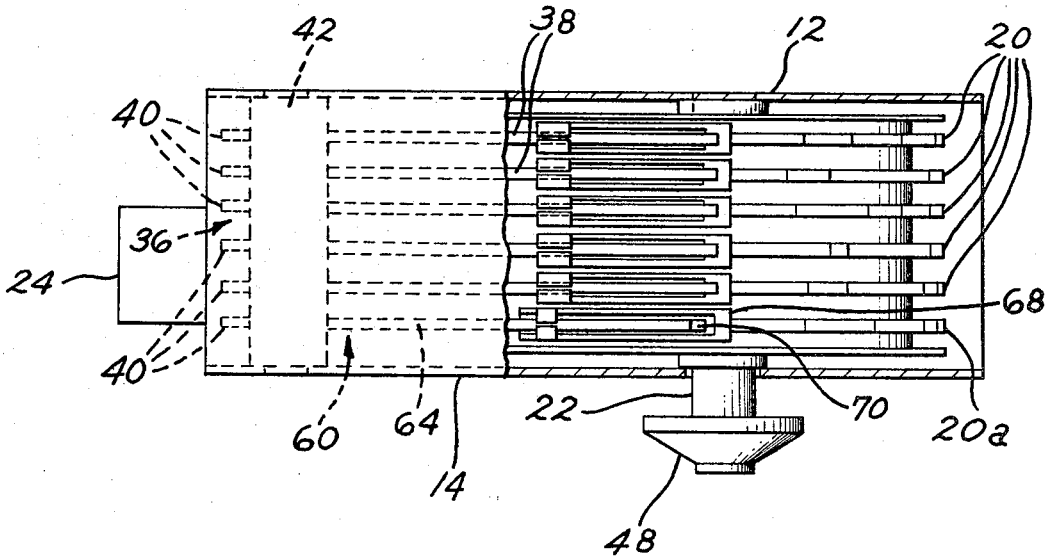
FIG. 2 is a top view of the timer of FIG. 1 with portions cut away to show a portion of the internal structure.

Referring now to FIGS. 1 and 2, the present invention is illustratively embodied by electromechanical timer 10. Structural support for timer 10 is primarily provided by frame 12 including a front plate 14 and a rear plate 16. A control cam 18, having a plurality of circumferential edge control cam surfaces or tracks 20 on its periphery, is formed integrally with a control cam-carrying shaft 22 which is rotatably mounted to frame 12. Control cam 18 is rotatably driven by driving means comprising a conventional timer motor 24 coupled to control cam 18 by a chain of gears 26, 28, 30, 32 and 34 (shown in phantom in FIG. 1) in a conventional manner well known in the art. A plurality of cam-actuated control switches designated generally 36 are suitably secured to frame 12 by a terminal block 42. Each one of switches 36 comprises a pair of contact arms, each comprising an upper arm 38 and a lower arm extending below and hidden from view by the upper arm. The contact arms extend from a terminal block 42 for actuation by control cam 18. Corresponding contacts 40 project from the opposite side of block 42 for electrically connecting the switches to external circuitry. Each contact arm carries a cam follower arranged for cam-following engagement with control cam surfaces 20. Control cam surfaces 20 are contoured to provide the desired sequential switch actuation. A timer control knob 48 is suitably mounted to that portion of shaft 22 extending outwardly through front plate 14 to permit user manipulation of the timer.

The timer structure and operation described thus far is typical of electro-mechanical timers well known in the art.

Typically, such timers are subject to fairly high tolerance variations in controlling time intervals. For example, for a 78 minute per revolution timer cam, such as is representative of timers used for domestic washing appliances, a 60 second fill time interval may have a plus or minus 8 second variation.

While such tolerances do not adversely affect satisfactory washing performance, it does adversely impact upon water usage. In order to minimize water usage, thereby reducing the amount of energy consumed in heating such water, it is desirable to provide an accurate means for controlling fill time intervals. This invention is directed to an improved cam-actuated switch arrangement which provides significantly improved accuracy for the relatively short time intervals associated with typical appliance fill cycles, but yet is of relatively simple and inexpensive construction.

In accordance with the present invention, timer 10 further includes cam-actuated switch 60 comprising first and second resilient contact arms 62 and 64, respectively, movable into and out of electrical contact with each other for opening and closing the switch. Each of contact arms 62 and 64 carries an oppositely disposed contact button 66. Each contact arm is self-biased toward the associated cam track 20A of control cam 18. A first cam-following member 68 rigidly extends from first contact arm 62 and is biased in cam-following engagement with cam track 20A by first contact arm 62. A second cam-following member 70 is movably mounted to first cam-following member 68 and extends between second contact arm 64 and cam track 20A. Cam following member 70 is biased into cam-following engagement with cam track 20A by second contact arm 64. By this arrangement, movement of the first and second contact arms is controlled by the first and second cam-following members, respectively, into and out of electrical contact with each other in accordance with the cam track profile.

Cam track 20A comprises a plurality of arcuate segments of different fixed radii defining a stepped profile. When the first and second cam-following members concurrently engage arcuate segments of substantially equal radii, the first and second contact arms are held out of electrical contact with each other. When a specific one of the cam-following members engages an arcuate segment of smaller radius than the other, the contact arms electrically contact each other. In the illustrative embodiment of the invention described herein, the first and second contact arms are held out of electrical contact with each other when the first and second cam-following members concurrently engage arcuate segments of substantially equal radius and are in electrical contact when the second cam-following member engages an arcuate segment of lesser radius than the arcuate segment concurrently engaged by the first cam-following member. By controlling switch operation in this way, the time period during which the switch means remains closed is a function of the arcuate distance between trailing edges of the first and second cam-following members. The direct connection between the first and second cam followers provides a common reference point, thereby substantially reducing tolerance variations by limiting the source of such variations to those associated with the distances from the common reference point to the cam followers trailing edges. A relatively tight tolerance can be maintained on this dimension without substantially increasing manufacturing costs.

The details of the structure of cam-following members 68 and 70 are best seen in FIGS. 3A and 3B. Both cam followers are molded plastic parts. Cam follower 68 comprises a mounting portion 72 and a head portion 74 joined by side wall portions 76. A flat supporting surface 78 is formed on the upper face of mounting portion 72 and underlays contact arm 62. Oppositely disposed heat staking tabs 80 project upwardly from supporting surface 78. During assembly, contact arm 62 is positioned over support surface 78 between tabs 80. Tabs 80 are then heat formed to securely engage and retain contact arm 62. When secured in this fashion, cam follower 68 rigidly extends from contact arm 62. Snap-on members 81 are formed in mounting portion 72 for pivotally supporting cam follower 70. Head portion 74 projects generally downwardly for cam-following engagement with the control cam track 20A. Side walls 76 define therebetween a longitudinal aperture 82 for receiving cam follower 70. Lower surface 84 of mounting portion 72 is tapered to provide clearance for the pivotal movement of cam follower 70 in aperture 82.

Cam follower 70 comprises a head portion 86 including a contact arm support surface 88 formed at its upper end and a cam-following surface 90 at its lower end. An elongated body portion 92 extends from the head portion and terminates in a reverse bent tail portion 94. A pair of fingers 96 are formed integrally with and project outwardly from opposite sides of tail portion 94. During assembly, fingers 96 are snap-fit into pivotal engagement with snap-on members 81 to pivotally secure cam follower 70 to cam follower 68. When so assembled, head portion 86 of cam follower 70 is received in aperture 82 of cam follower 68 with contact arm support surface 88 projecting above cam follower 68 for supportingly engaging contact arm 64. Cam-following surface 90 projects beneath side wall portions 76 for cam-following engagement with control cam track 20A.

Separation of surfaces 88 and 90 of cam follower 70 is selected relative to the vertical dimension of heat portion 74 of cam follower 68 such that when cam followers 68 and 70 concurrently engage segments of substantially equal radii, contact arms 62 and 64 are sufficiently separated to prevent electrical contact between contacts 66, and to permit electrical contact therebetween when follower 70 engages a segment of lesser radius than that engaged by follower 68.

As will become more apparent in the ensuing description of operation, the critical dimensions in this assembly for timing accuracy are the distances between mating pivot surfaces 99 of snap-on members 81 and the trailing edge 100 for follower 68 and the pivot surface 101 and trailing edge 102 for follower 70. It is believed that with conventional manufacturing techniques, the tolerances for these members can readily be held to plus or minus 0.001 inches.

As mentioned hereinbefore, the present invention may be advantageously used to control the duration of the fill cycle for washing appliances. In the description of the operation of timer 10 to follow switch 60 is adapted to control energization of a dishwasher fill valve solenoid 90 represented schematically in FIG. 4. Solenoid 90 is serially connected to contacts 40 (FIG. 5A) of switch 60 between power lines L1 and L2. When switch 60 is closed solenoid 90 is energized and the fill valve is open; when switch 60 is open, solenoid 90 is deenergized and the fill valve is closed.

Figure 5A:
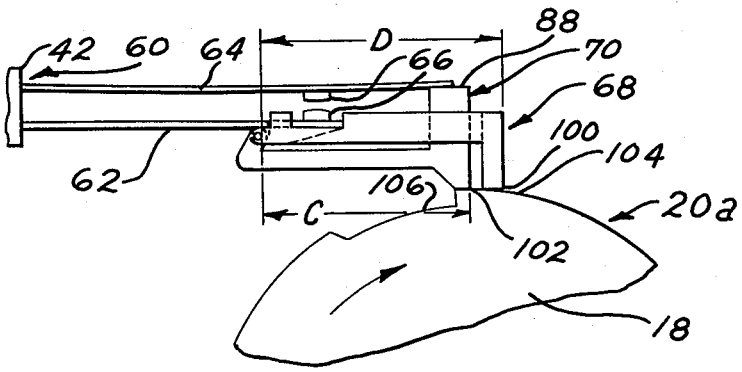
FIG. 5A is a partial view of the timer of FIG. 1 showing the contact arms of a cam-actuated switch in their initial open position.
Figure 5B:
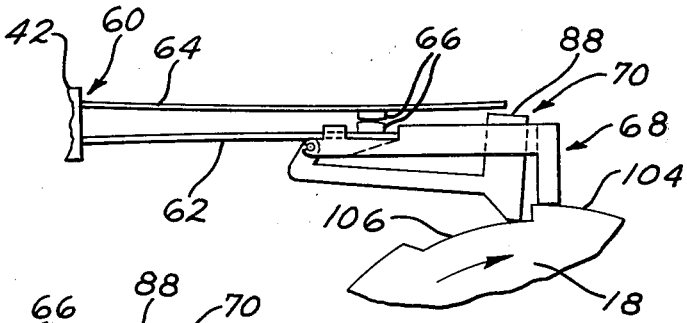
FIG. 5B is a partial view of the timer of FIG. 1 showing the cam-actuated switch of FIG. 4 in its closed position.
Figure 5C:
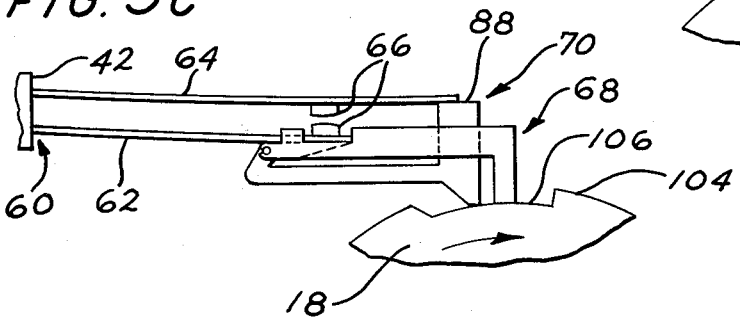
FIG. 5C is a partial view of the timer of FIG. 1 showing the cam-actuated switch of FIG. 4 in its second open position.
Figure 5D:
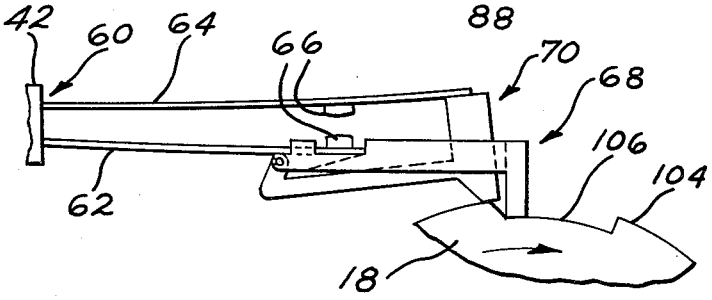
FIG. 5D is a partial view of the timer of FIG. 1 showing the cam-actuated switch of FIG. 4 in its partial reset position.

Operation of switch 60 of timer 10 will now be described with reference to FIGS. 5A–5D. In FIG. 5A, switch 60 is shown in its reset position with cam followers 68 and 70 concurrently engaging arcuate segment 104 of the cam track with equal radius. Support surface 88 of cam follower 70 engages contact arm 64 to separate contact arm 64 from contact arm 62, thereby preventing electrical contact between contacts 66. As control cam 18 rotates in a clockwise direction, the biasing action of arm 62 causes cam follower 70 to drop to arcuate segment 104 of lesser diameter than segment 106 engaged by cam follower 68, as seen in FIG. 5B. As cam follower 70 drops, the self-biasing action of arm 64 drops contact arm 64 into electrical contact with arm 62 thereby closing switch 60 and initiating fill by permitting energization of the fill control solenoid 90 (FIG. 4). Fill continues until cam follower 68 drops to arcuate segment 106 at which time contact arm 62 drops out of electrical contact with contact arm 64 which is retained by surface 88 of cam followers 70 opening switch 60 thereby deenergizing solenoid 90 and terminating fill. This position is illustrated in FIG. 5C. The reset transition from the position of FIG. 4 back to the position of FIG. 5A occurs in two steps. First, as control cam 18 continues to rotate, switch 60 is returned to its reset position as cam follower 70 returns to the initial cam track radius, as shown in FIG. 5D. As cam 18 continues to rotate, cam-following member 68 similarly returns to the original cam track radius, bringing contact arms and cam followers to the position shown in FIG. 5A. Since cam follower 70 rides up the cam track ahead of cam follower 68, contacts 66 remain apart throughout this reset transition.

In this arrangement the duration of fill time is determined by the rate of rotation of control cam 18 and the arcuate distance between trailing edge 102 of cam follower 70 and trailing edge 100 of cam follower 68, as seen in FIG. 5A. Consequently, maintenance of a tight tolerance on the duration of the fill time interval requires only maintaining a tight tolerance on dimension C of cam follower 70 and dimension D of cam follower 68. In the illustrative embodiment, the timer 10 is a 78 minute per revolution timer. Desired nominal fill time is 42 seconds requiring arcuate distance between trailing edges 100 and 102 of 0.080 inches. Assuming reasonable tooling tolerances for followers 70 and 80 of plus or minus 0.001 inches, the fill time is on the order of 42 seconds plus or minus 0.5 seconds. This is a substantial improvement over the plus or minus 8 seconds typically associated with conventional electro-mechanical timer for such applications.

In some applications, it may be desirable to provide fill intervals of different duration during the appliance operating cycle. In another form of the invention, the time period can be extended by providing one or more additional cam track drops prior to reset of the cam followers. In accordance with this aspect of the invention, the plurality of arcuate segments defining the cam track profile includes first and last arcuate segments and one or more intermediate arcuate segments, each of a different fixed radius sequentially arranged in order of decreasing radius in the direction opposite the direction of rotation of the control cam. In this arrangement, the arcuate length of each intermediate segment must be less than the arcuate distance between the trailing edges of the first and second cam-following members so that the second cam-following member moves from its current intermediate segment to the next succeeding segment before the first cam-following member moves from its current segment. By this arrangement, the time period during which the switch means remains closed can be extended as a function of the sum of the arcuate lengths of the intermediate segments of the cam track.

Figure 6F:
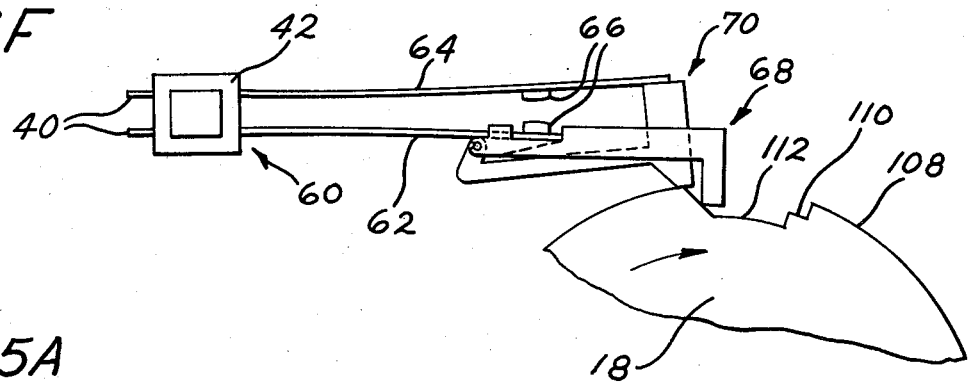
FIG. 6F is a partial view of the timer of FIG. 1 showing the cam-actuated switch of FIG. 5A returning to its reset position.
Figure 6A:
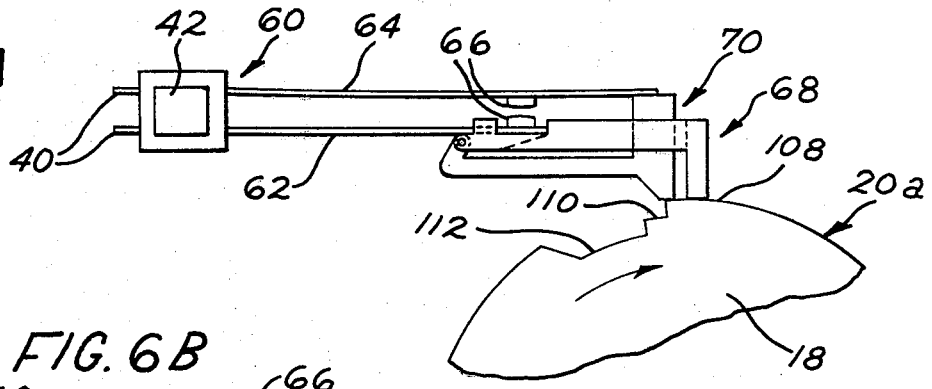
FIG. 6A is a view of the timer of FIG. 1 with a cam-actuated switch in its reset position.
Figure 6B:
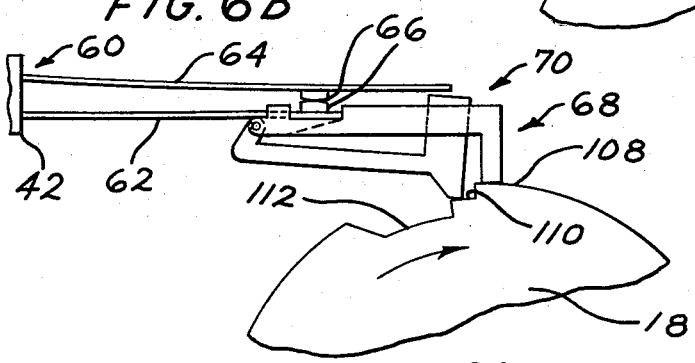
FIG. 6B is a partial view of the timer of FIG. 1 with the cam-actuated switch of FIG. 5A in its initial closed position.

Referring now to FIGS. 6A–6F, the operation of the mechanical timer 10 of FIG. 1 embodying this aspect of the present invention will be described. As seen in FIG. 6A, cam track 20A is provided with a first arcuate segment 108, a second, or intermediate, arcuate segment 110 of a radius less than segment 108, and a third or last arcuate segment 112 of a lesser radius than segment 110, the segments being sequentially arranged in order of decreasing radius in the direction opposite the direction rotation of the control cam. In FIG. 6A, switch 60 is seen in its reset position with cam-following members 68 and 70 resting on the arcuate segment 108. In this position, contact arm 64 is held out of contact with contact arm 62 by cam follower 70. As control cam 18 rotates in the clockwise direction, cam follower 70 moves from segment 108 to segment 110, as seen in FIG. 6B, permitting contact arm 64 to drop into electrical contact with contact arm 62 thereby initiating the fill operation by closing switch 60, permitting energization of the fill valve solenoid 90 (FIG. 4).

Figure 6C:
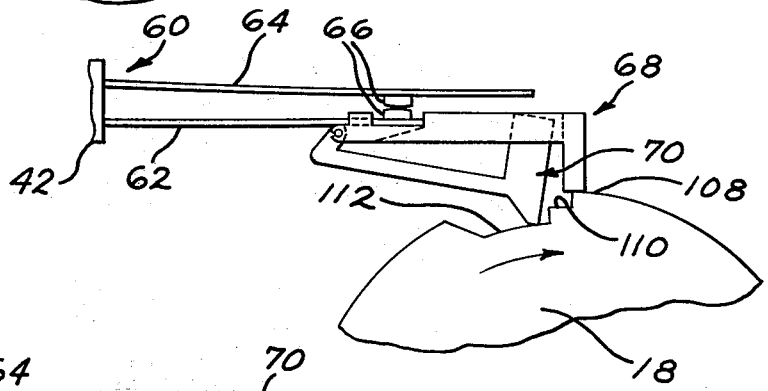
FIG. 6C is a partial view of the timer of FIG. 1 showing the cam-actuated switch of FIG. 5A in its first extended fill position.
Figure 6D:
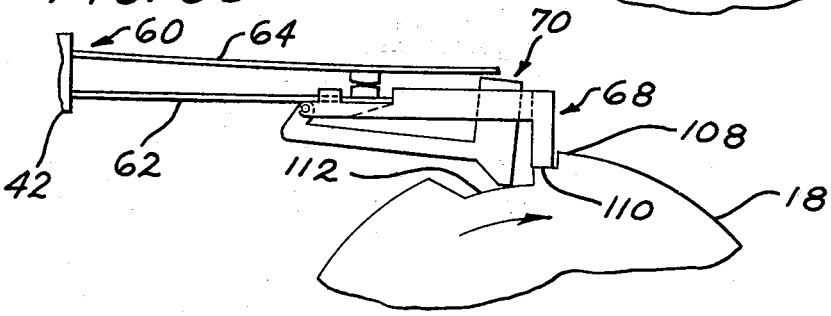
FIG. 6D is a partial view of the timer of FIG. 1 showing the cam-actuated switch of FIG. 5A in its second extended fill position.
Figure 6E:
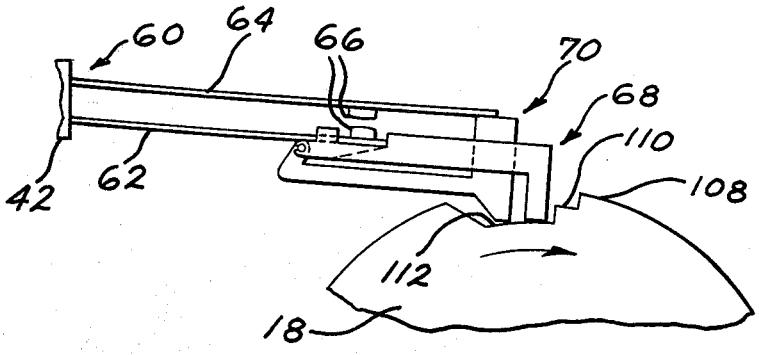
FIG. 6E is a partial view of the timer of FIG. 1 showing the cam-actuated switch of FIG. 5A in its fill termination position.

As control cam 18 continues to rotate, cam-following member 70 moves from arcuate segment 110 to arcuate segment 112, as seen in FIG. 6C. The arcuate length of segment 110 is selected to be less than the distance from between trailing edges 100 and 102 of members 68 and 70, respectively, to insure that member 70 drops from segment 110 to segment 112 before member 68 drops from segment 108 to segment 110. This is necessary to prevent members 68 and 70 from riding on the same arcuate segment thereby opening switch 60 and interrupting energization of the fill valve solenoid. As control cam 18 continues to rotate, cam-following member 68 drops from arcuate segment 108 to segment 110, as seen in FIG. 6D. However, switch 60 remains in its closed state with contact arm 64 in electrical contact with contact arm 62. The fill period terminates when cam-following member 68 drops from arcuate segment 110 to arcuate segment 112, as shown in FIG. 6E. In this position, cam-following members 68 and 70 are once again concurrently engaging arcuate segments of equal radius. Movement of cam member 68 from segment 110 to segment 112 drops contact arm 62 out of electrical contact with contact arm 64 which is retained in its position by cam-following member 70. FIG. 6F shows cam members 68 and 70 returning to their reset position. It is understood that while the embodiment shown uses two drops, additional drops could be provided if further extension of time intervals were desired.

In the embodiment described with reference to FIGS. 6A–6F, the total duration of the fill period is a function of the distance between trailing edges 100 and 102 of members 68 and 70, respectively, plus the arcuate length of arcuate segment 110. In the configuration of illustrative embodiment, the arcuate length of segment 110 may be varied from roughly 0.012 inches to 0.072 inches. These constraints provide practical physical overlaps for reliable operation. For a 78 minute per revolution timer, this equates to a time extension in the range of 6 to 36 seconds. It is believed that with conventional manufacturing practices the tolerance on this dimension can be held to plus or minus 0.001 inches corresponding to plus or minus 0.55 seconds. Thus, in this arrangement, there is a basic time of 42 seconds plus or minus 0.5 seconds determined by the distance between trailing edges 100 and 102, plus an extended time in the range of 6 to 36 seconds determined by the desired length of segment 110 with a tolerance of plus or minus 0.55 seconds to provide a total fill control interval in the range of 48 to 78 seconds with a tolerance slightly in excess of plus or minus one second. It is apparent that even with the added tolerance variation for the extended time period, the total tolerance variation is still substantially less than comparable timers known in the art.

While specific embodiments of the invention have been illustrated and described herein, it is realized that numerous modifications and changes will occur to those skilled in the art. For example, cam follower 70 could be slidably supported in cam follower 68 rather than pivotally mounted as shown. It is therefore to be understood that the appended claims are intended to cover all such modifications and changes as fall within the true spirit and scope of the invention.

What is claimed is:

1. An electromechanical timer comprising:

a control cam having a circumferential edge cam track; said cam track comprising a plurality of arcuate segments, each segment having a fixed radius different than the fixed radius of an adjacent segment defining a stepped cam track profile;

switch means comprising first and second resilient contact arms extending generally adjacent said cam track, said first contact arm extending between said second contact arm and said cam track;

a first cam-following member rigidly mounted to said first contact arm and biased into cam-following engagement with said cam track by said first contact arm;

a second cam-following member pivotally mounted to said first cam-following member and biased into cam-following engagement with said cam track by said second contact arm;

said first and second cam-following members being operative to control movement of said first and second contact arms, respectively, into and out of electrical contact with each other in accordance with said cam track profile;

said first and second cam-following members having effective dimensions radially of said cam such that said second cam-following member engages said second contact arm to hold said second contact arm out of electrical contact with said first contact arm when said first and second cam-following members engage the same segment of said cam track; and the difference in the fixed radii of said cam track segments being sufficient that said second cam-following member permits said second contact arm to come into electrical contact with said first contact arm when said second cam-following member is aligned with one cam track segment and said first cam-following member is aligned with another cam track segment having a longer fixed radius than said one cam track segment.

2. The electromechanical timer of claim 1 wherein said plurality of arcuate segments includes a first segment, a last segment and one or more intermediate segments, each of a different fixed radius, sequentially arranged in order of decreasing radius in the direction opposite the direction of rotation of said control cam;

the arcuate length of each of said intermediate segments being less than the arcuate distance between said first and second cam-following members such that said second cam-following member moves from its current segment to the next succeeding segment before said first cam-following member moves from its current segment whereby the time period during which said switch means remains closed is extended as a function of the sum of the arcuate lengths of each of said intermediate segments.

3. The electromechanical timer of claim 1 wherein said plurality of arcuate segments defining said cam track profile includes first, second and third segments having first, second and third fixed radii respectively sequentially arranged in order of decreasing radius in the direction opposite the direction of rotation of said control cam; the arcuate length of said second segment being less than the arcuate distance between said first and second cam-following members such that said second cam-following member moves from said second segment to said third segment before said first cam-following member moves from said first segment to said second segment whereby the time period during which said switch means remains closed is extended as a function of the arcuate length of said second segment.

4. An electromechanical timer comprising:

a frame;

a control cam rotatably mounted to said frame, said control cam including at least one circumferential edge cam track comprising a plurality of arcuate segments, each segment having a fixed radius different than the fixed radius of an adjacent segment defining a stepped cam track profile;

a timer motor mounted to said frame and coupled to said control cam for rotatably driving said control cam; and at least one cam-actuated switch means mounted to said frame comprising;

first and second resilient contact arms extending generally adjacent said cam track, said first contact arm extending between said second contact arm and said cam track;

a first cam-following member rigidly mounted to said first contact arm and biased into cam-following engagement with said cam track by said first contact arm;

a second cam-following member pivotally mounted to said first cam-following member and biased into cam-following engagement with said cam track by said second contact arm;

said first and second cam-following members being operative to control movement of said first and second contact arms, respectively, into and out of electrical contact with each other in accordance with said cam track profile;

said first and second cam-following members having effective dimensions radially of said cam such that said second cam-following member engages said second contact arm to hold said second contact arm out of electrical contact with said first contact arm when said first and second cam-following members engage the same segment of said cam track; and the difference in the fixed radii of said cam track segments being sufficient that said second cam-following member permits said second contact arm to come into electrical contact with said first contact arm when said second cam-following member is aligned with one cam track segment and said first cam-following member is aligned with another cam track segment having a longer fixed radius than said one cam track segment whereby the time period during which said first and second contact arms are in electrical contact is a function of the arcuate distance between said first and second cam-following members.

5. The electromechanical timer of claim 4 wherein said plurality of arcuate segments includes a first segment, a last segment and one or more intermediate segments, each of a different fixed radius, sequentially arranged in order of decreasing radius in the direction opposite the direction of rotation of said control cam;

the arcuate length of each of said intermediate segments being less than the arcuate distance between said first and second cam-following members such that said second cam-following member moves from its current segment to the next succeeding segment before said first cam-following member moves from its current segment whereby the time period during which said switch means remains closed is extended as a function of the sum of the arcuate lengths of each of said intermediate segments.

6. The electromechanical timer of claim 4 wherein said plurality of arcuate segments defining said cam track profile includes first, second and third segments having first, second and third fixed radii respectively sequentially arranged in order of decreasing radius in the direction opposite the direction of rotation of said control cam; the arcuate length of said second segment being less than the arcuate distance between said first and second cam-following members such that said second cam-following member moves from said second segment to said third segment before said first cam-following member moves from said first segment to said second segment whereby the time period during which said switch means remains closed is extended as a function of the arcuate length of said second segment.

* * * * *